US006148936A

United States Patent [19]

Evans et al.

[11] Patent Number: 6,148,936

[45] Date of Patent: Nov. 21, 2000

[54] METHODS OF MANUFACTURING ROTARY DRILL BITS

[75] Inventors: Stephen Martin Evans, Standish; Andrew Bell, Eastington, both of United Kingdom

[73] Assignee: Camco International (UK) Limited, Stonehouse, United Kingdom

[21] Appl. No.: 09/244,471

[22] Filed: Feb. 4, 1999

[30] Foreign Application Priority Data

Oct. 22, 1998 [GB] United Kingdom ..... 9822979

[51] Int. Cl.[7] ..... E21B 10/08; E21B 10/62

[52] U.S. Cl. ..... 175/425; 175/374

[58] Field of Search ..... 175/425, 426, 175/331, 374, 385, 386, 387, 390, 391, 393, 434, 435; 76/108.2, 108.4, 107.1

[56] References Cited

U.S. PATENT DOCUMENTS

| | | | |
|---|---|---|---|
| 4,919,013 | 4/1990 | Smith et al. | 175/329 X |
| 5,101,692 | 4/1992 | Simpson . | |
| 5,358,026 | 10/1994 | Simpson . | |
| 5,373,907 | 12/1994 | Weaver | 175/426 |
| 5,441,121 | 8/1995 | Tibbitts . | |
| 5,666,864 | 9/1997 | Tibbitts . | |
| 5,732,783 | 3/1998 | Truax et al. | 175/374 |
| 5,944,128 | 8/1999 | Truax et al. | 175/374 |
| 5,992,547 | 11/1999 | Caraway et al. | 175/385 |

FOREIGN PATENT DOCUMENTS

| | | |
|---|---|---|
| 2 075 396 | 11/1981 | United Kingdom . |
| WO98/13159 | 4/1998 | WIPO . |

*Primary Examiner*—Robert E. Pezzuto
*Attorney, Agent, or Firm*—Jeffery E. Daly

[57] ABSTRACT

A rotary drill bit is manufactured by a powder metallurgy process by placing a metal mandrel in a mold, packing the mold with particulate matrix-forming material, infiltrating the material with a molten binding alloy, and cooling the assembly to form a solid infiltrated matrix bonded to the mandrel. The mandrel comprises an outer part surrounded by the matrix-forming material and an inner part, secured to the outer part but out of contact with the matrix-forming material. The outer part of the mandrel is formed from a material having thermal characteristics close to those of the matrix, so as to reduce the tendency for the matrix to crack under thermal stress, while the inner part of the mandrel is formed from a precipitation-hardening material, the strength and hardness of which increases in the infiltration process and the subsequent heating/cooling cycle for brazing the cutters on to the drill bit. The threaded shank of the drill bit is formed directly on the inner part since it will have sufficient strength and hardness for this purpose.

25 Claims, 4 Drawing Sheets

METHODS OF MANUFACTURING ROTARY DRILL BITS

BACKGROUND OF THE INVENTION

1. Field of the Invention

The invention relates to methods of manufacturing rotary drill bits, and particularly rotary drag-type drill bits of the kind comprising a bit body having a threaded shank for connection to a drill string and a leading face on which are mounted a plurality of cutters.

The cutters may, for example, be preform cutting elements comprising a layer of superhard material, such as polycrystalline diamond, bonded to a substrate of less hard material, such as cemented tungsten carbide. The substrate of the cutting element may be bonded, for example by brazing, to a carrier which may also be of cemented tungsten carbide, the carrier then being brazed within a socket on the leading face of the bit body. Alternatively, the substrate of the cutter may itself be of sufficient size to be brazed directly within a socket in the bit body.

2. Description of Related Art

Drag-type drill bits of this kind are commonly of two basic types. The bit body may be machined from metal, usually steel, and in this case the sockets to receive the cutters are formed in the bit body by conventional machining processes. The present invention, however, relates to the alternative method of manufacture where the bit body is formed using a powder metallurgy process. In this process a metal mandrel is located within a graphite mold, the internal shape of which corresponds to the desired external shape of the bit body. The space between the mandrel and the interior of the mold is packed with a particulate matrix-forming material, such as tungsten carbide particles, and this material is then infiltrated with a binder alloy, usually a copper alloy, in a furnace which is raised to a sufficiently high temperature to melt the infiltration alloy and cause it to infiltrate downwardly through the matrix-forming particles under gravity. The mandrel and matrix material are then cooled to room temperature so that the infiltrate solidifies so as to form, with the particles, a solid infiltrated matrix surrounding and bonded to the metal mandrel.

Sockets to receive the cutters are formed in the matrix by mounting graphite formers in the mold before it is packed with the particulate material so as to define sockets in the material, the formers being removed from the sockets after formation of the matrix. Alternatively or additionally, the sockets may be machined in the matrix. The cutters are usually secured in the sockets by brazing.

In order to braze the cutters in place the cutters are located in their respective sockets with a supply of brazing alloy. The bit body, with the cutters in place, is then heated in a furnace to a temperature at which the brazing alloy melts and spreads by capillary action between the inner surfaces of the sockets and the outer surfaces of the cutters, an appropriate flux being used to facilitate this action.

During the process of brazing the cutters to the bit body, the bit body must be heated to a temperature which is usually in the range of 500°–750° and with the steels hitherto used in the manufacture of the bit bodies of rotary drag-type bits, the heating/cooling cycle employed during infiltration of the matrix and during brazing of the cutters in position has the effect of reducing the hardness and strength of the steel. In view of this, it has been the common practice to manufacture the steel mandrel of a matrix bit in two parts. A first part is mounted within the mold so that the solid infiltrated matrix may be bonded to it and the second part of the mandrel, providing the threaded shank, is subsequently welded to the first part after the matrix has been formed and after the cutters have been brazed into the sockets in the matrix. The part of the mandrel providing the shank does not therefore have its hardness or strength reduced by the brazing process nor by the heating/cooling cycle of the infiltration process.

It would be desirable to avoid this necessity of welding a separate shank part to the mandrel after formation of the matrix, since this not only adds to the cost of the manufacturing process but the necessity of welding the parts together may compromise the design of the bit body. For example, the bit body must be of sufficient length, and so shaped, as to provide a region where the two parts can be welded together. Accordingly, a one-piece mandrel could be shorter in length than a two-piece body and this may have advantage, particularly where the drill bit is for use in steerable drilling systems.

Clearly, the necessity of subsequently welding a separate shank part to the mandrel of the bit after formation of the matrix could be avoided if the mandrel were to be formed from a material which was not reduced in hardness and strength during the heating/cooling cycle employed during the brazing of the cutters on the drill bit. This would enable the mandrel to be formed in one piece, including a portion to provide the threaded shank of the drill bit.

One type of material which might be used for this purpose is a precipitation hardening alloy, such as a precipitation hardening steel or stainless steel. A characteristic of a precipitation hardening alloy is that it hardens when subjected to an appropriate heating/cooling cycle and it is therefore possible to control the heating/cooling cycle to which the drill bit is subjected during brazing of the cutters on the bit in such a manner as to harden the alloy of the mandrel.

However, alloys of this type have different thermal characteristics from the matrix formed around the mandrel in the manufacture of the matrix drill bit, and a result of this mis-match of thermal characteristics may be a tendency for the matrix to crack either during the cooling of the matrix and mandrel following the infiltration of the matrix, or in the subsequent heating/cooling cycle for brazing the cutters to the bit body.

The present invention sets out to overcome this problem while still permitting the mandrel to include a portion to provide the threaded shank of the drill bit without the necessity of welding such portion to the mandrel after formation of the matrix.

SUMMARY OF THE INVENTION

According to the invention there is provided a method of manufacturing a rotary drill bit of the kind comprising a bit body having a threaded shank for connection to a drill string and a leading face on which cutters are mounted, the method including the step of locating a metal mandrel within a mold, packing the mold around at least part of the mandrel with particulate matrix-forming material, infiltrating said material at elevated temperature with a molten binding alloy, and cooling the material, binding alloy and mandrel to form a solid infiltrated matrix bonded to the mandrel, the mandrel being formed in at least two parts including an outer part surrounded by a main body of said matrix-forming material and an inner part which engages with the outer part of the mandrel and is out of contact with said main body of matrix-forming material.

By forming the mandrel in two parts in this manner, the inner part of the mandrel may have characteristics such that its strength and hardness are not reduced in the infiltration process and the subsequent heating/cooling cycle for brazing the cutters on to the drill bit. This not only strengthens the bit as a whole, but also allows the inner part of the mandrel to include a portion to provide the threaded shank of the drill bit since the inner part of the mandrel will have sufficient strength and hardness for this purpose. At the same time, the outer part of the mandrel may be selected from a material having thermal characteristics closer to those of the main body of matrix, thus reducing or avoiding the tendency for the matrix to crack under thermal stress.

Accordingly, the inner part of the mandrel may be formed from a precipitation hardening alloy and the outer part of the mandrel may be formed from a non-precipitation hardening alloy, the method including the step of submitting the mandrel to a heating and cooling cycle in a manner to effect precipitation hardening of the alloy from which the inner part is formed. For example, the heating and cooling cycle may be that applied in the infiltration process and/or in a process for subsequently brazing cutters to the bit body. The alloy may be a precipitation hardening steel. For example it may be a martensitic or semi-austenitic type steel. It may be a stainless steel. However, the invention is not limited to the use of steel or stainless steel for the inner part of the mandrel and the use of other alloys and particularly precipitation hardening alloys is contemplated, for example nickel based alloys.

As is well known, a precipitation hardening alloy is an alloy in which very fine particles of constituents of the alloy may be caused to precipitate, i.e. initiate and grow from the parent alloy, so as to harden and strengthen the alloy. Such precipitation may be effected by subjecting the alloy to a controlled heating and cooling cycle.

The initiation and growth of precipitates ("precipitation") is a diffusion process, i.e. it is controlled by time and temperature. A certain threshold amount of energy is required to trigger initiation. In certain alloys, there is sufficient energy at room temperature to trigger initiation; albeit at a very slow pace. In the majority of alloys, however, an elevated temperature, and a minimum time at that temperature, is required to trigger initiation.

The size of the precipitates is critical to the degree of hardness, strength, and ductility obtained. The precipitation hardening effect arises from the precipitates causing local distortion of the crystal lattice. The greatest hardness (and the lowest ductility) is achieved when the precipitates are numerous and exceptionally fine. As the temperature is increased above a threshold temperature, larger and fewer particles are precipitated and, as a result, hardness decreases and ductility increases. As the temperature is raised further, there comes a point where the particles are too few and too large to contribute appreciably to the hardness/strength of the alloy.

A "solution" heat treatment in which the alloy is raised to an even higher temperature, acts to "dissolve" the majority of existing precipitates, by taking them back into the solid solution. Subsequent cooling to room temperature tends to lock the precipitation hardening elements into solid solution. The faster the cooling rate, the greater is this tendency. The slower the cooling rate, the more chance there is to initiate and grow precipitates during the cooling cycle. The precipitates created during the cooling cycle, from the higher temperature, tend to be less beneficial to increasing hardness/strength than those created by a subsequent, separate, precipitation hardening heat treatment.

The overall object, according to the invention, therefore, is to subject the alloy from which the inner part of the mandrel is formed to a combination of time and temperature which causes precipitation hardening and gives rise to the optimum hardness/ductility combination. In theory, this may be achieved by first taking all the precipitates into solution at a high "solution treatment" temperature; followed by fast cooling to room temperature; followed by heating quickly to a lower precipitation hardening temperature and holding at that temperature for a prescribed time; followed by a fast cool back to room temperature. Precipitation hardening may also be effected by performing the latter precipitation hardening step alone.

As previously mentioned, the necessary heating/cooling cycle to effect precipitation hardening of the inner part of the mandrel may be achieved by suitable control of the heating/cooling cycles to which the bit body is subjected during manufacture. For example, the heating/cooling cycle to which the bit body is subjected during the infiltration process may be controlled so as to effect a preliminary "solution" heat treatment prior to precipitation hardening effected by controlling the heating/cooling cycle to which the bit body is subjected during brazing the cutters to the bit body. However, the invention does not exclude methods where precipitation hardening of the inner part of the mandrel is achieved by a separate heating/cooling cycle unconnected with the normal stages of manufacture of the bit body.

The outer part of the mandrel may be formed from a non-corrosion-resistant steel. The steel may be what is known as a "Plain-Carbon" steel. For example, it may be a steel of the grade identified as EN8 and having a carbon content in the range of 0.36% to 0.44%. Other suitable steels are grades identified as AISI1018, AISI1019, AIAI1020, AISI1021 and AISI1022 having a carbon content in the range of 0.15% to 0.23%.

The inner part of the mandrel may be engaged with the outer part of the mandrel by any suitable method, including for example a threaded connection, an interference fit, an adhesive or welding.

Preferably there is provided between the inner and outer parts of the mandrel a brazing gap which is filled with molten brazing alloy during the infiltration of the matrix-forming material at elevated temperature, so as to braze the inner part to the outer part. The brazing alloy may comprise part of the binding alloy which infiltrates the matrix-forming material, but may also comprise a different alloy applied separately to the brazing gap.

The matrix-forming material packed around the mandrel may include a portion, in addition to said main body of matrix-forming material, which engages a surface of the inner part of the mandrel. For example, the inner part of the mandrel may include an internal passage which is lined with matrix-forming material.

In any of the above arrangements the inner part of the mandrel is preferably coaxial with the outer part of the mandrel. For example, the inner part may have a cylindrical portion which engages within a registering cylindrical socket in the outer part.

The method may include the further step of machining an integral portion of the inner part of the mandrel to form the threaded shank of the drill bit. Alternatively, a separately formed member may be welded or otherwise secured to the inner part of the mandrel, after formation of the solid infiltrated matrix, to form the threaded shank of the drill bit.

The invention also provides a rotary drill bit comprising a bit body having a threaded shank for connection to a drill string and a leading face on which cutters are mounted, the bit body comprising a metal mandrel, around part of the outer surface of which is formed a main body of solid infiltrated matrix material, said mandrel comprising an outer part surrounded by said main body of solid infiltrated matrix material, and an inner part which engages the outer part, said inner part being formed of an alloy which has been precipitation hardened.

DETAILED DESCRIPTION OF THE PREFERRED EMBODIMENTS

Figure 1:
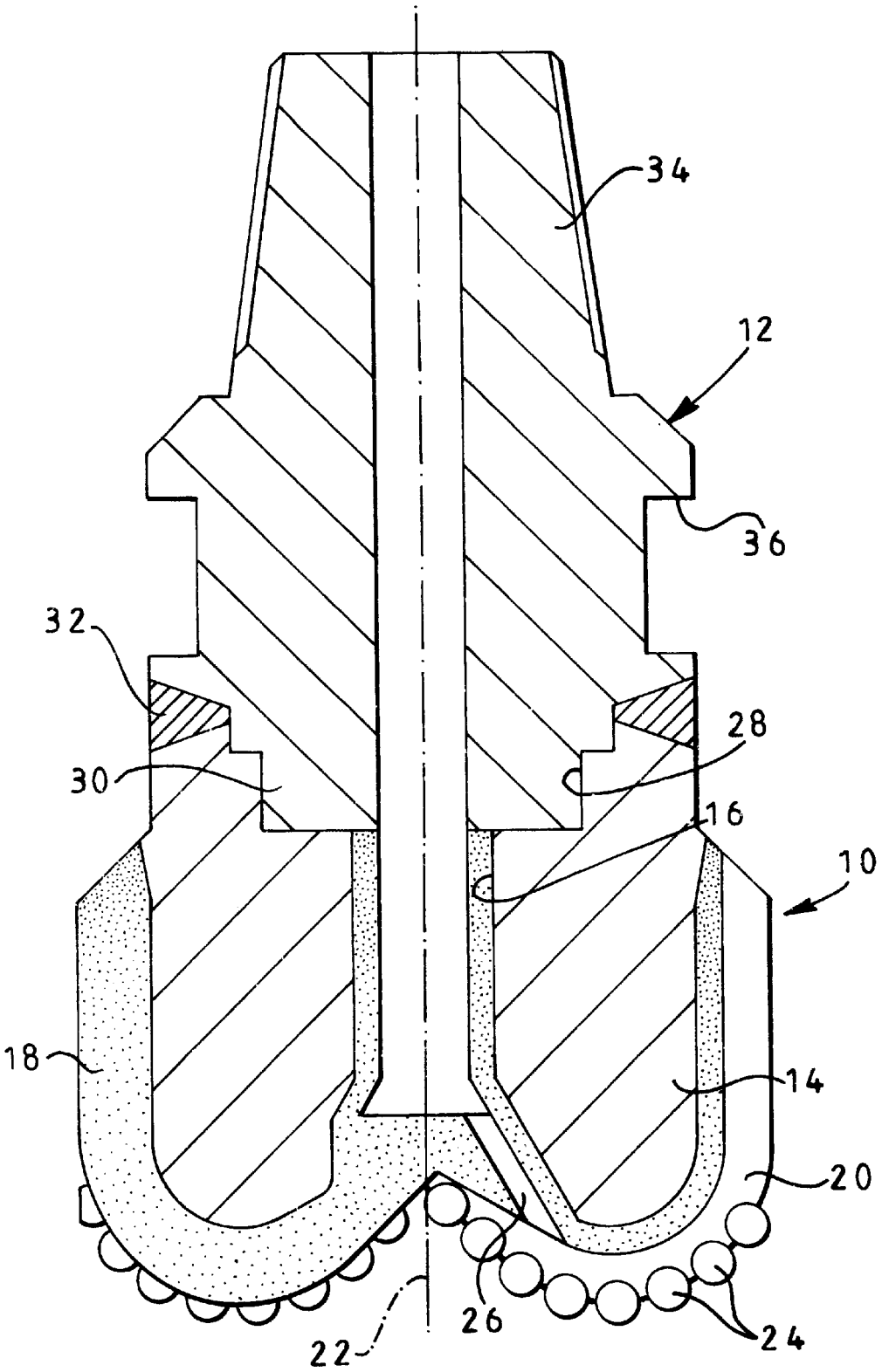
FIG 1 (Prior art)
FIG. 1 is a diagrammatic section through a prior art matrix-bodied drill bit.

FIG. 1 shows a prior art matrix-bodied drill bit. The main body of the drill bit comprises a leading part 10 and a shank part 12. The leading part 10 includes a steel mandrel 14 having a central passage 16. The lower portion of the mandrel 14 is surrounded by a body 18 of solid infiltrated matrix material which defines the leading face of the drill bit and provides a number of upstanding blades 20 extending outwardly away from the central axis of rotation 22 of the bit. Cutters 24 are mounted side-by-side along each blade 20 in known manner. The passage 16 in the mandrel 14 is also lined with solid infiltrated matrix and the passage communicates through a number of subsidiary passages 26 to nozzles (not shown) mounted in the leading surface of the bit body between the blades 20.

The upper part of the mandrel 14 is formed with a stepped cylindrical socket 28 in which is received a correspondingly shaped projection 30 on the lower end of the shank part 12. The shank part 12 is welded to the mandrel 14 as indicated at 32. The shank part is formed, in known manner, with a tapered threaded pin 34 by means of which the bit is connected to a drill collar at the lower end of the drill string, and breaker slots 36 for engagement by a tool during connection and disconnection of the bit to the drill collar.

Figure 2:
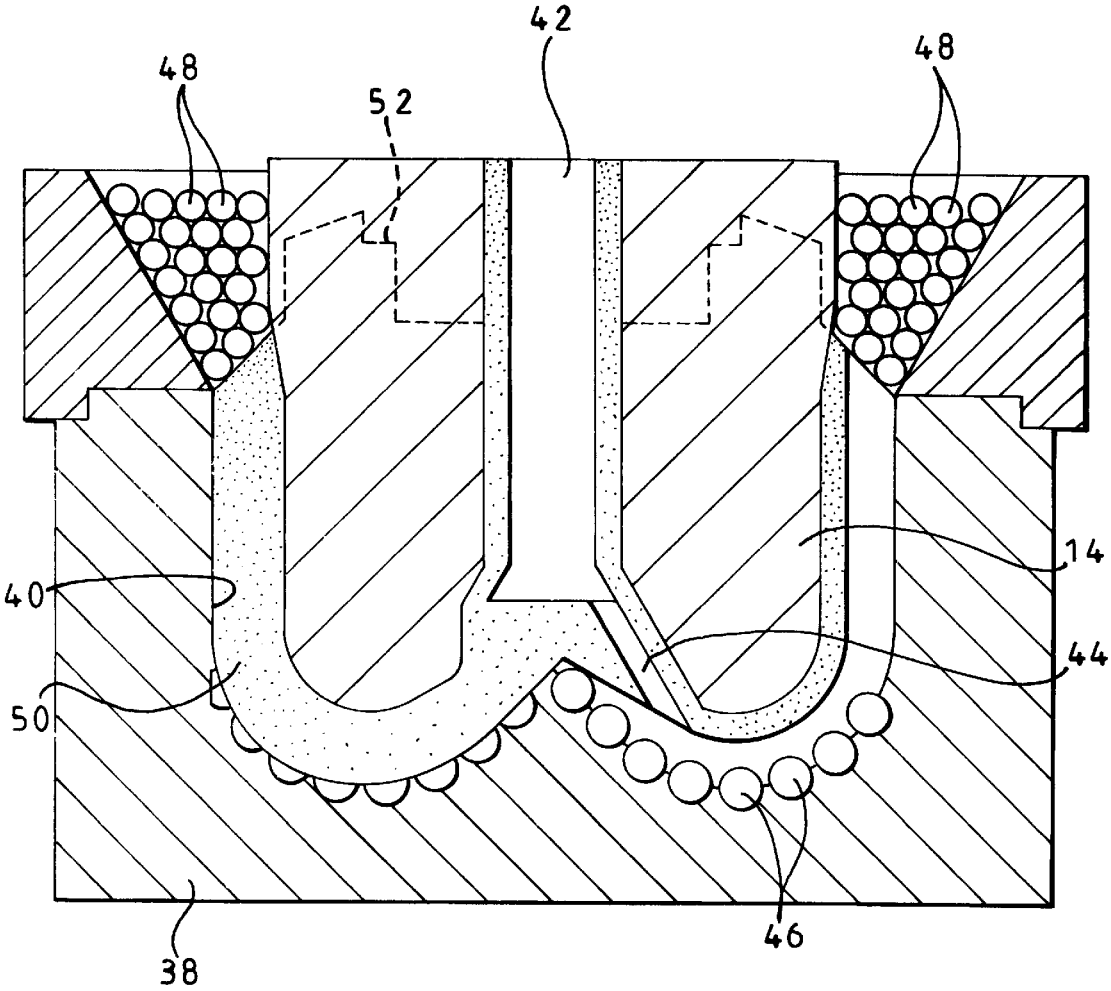
FIG 2 (Prior art)
FIG. 2 shows diagrammatically the prior art method of manufacture of the drill bit of FIG. 1.

FIG. 2 shows diagrammatically the manner of manufacture of the prior art bit of FIG. 1. The bit is formed in a machined graphite mold 38 the inner surface 40 of which corresponds substantially in shape to the desired outer configuration of the leading part of the bit body, including the blades 20.

The metal mandrel 14, which is usually formed from steel, is supported within the mold 38. Formers 42, 44 are located within the mold so as to form the central passage in the bit body and the subsidiary passages leading to the nozzles. Graphite formers 46 are also located on the interior surface of the mold to form the sockets into which the cutters will eventually be brazed.

The spaces between the mandrel 14 and the interior of the mold 38 are packed with a particulate matrix-forming material, such as particles of tungsten carbide, this material also being packed around the graphite formers 42, 44 and 46. Bodies 8 of a suitable binder alloy, usually a copper based alloy, are then located in an annular chamber around the upper end of the mandrel 14 and above the packed matrix-forming material 50.

The blades 20 of the bit may be entirely formed of matrix or metal cores may be located in the mold at each blade location so as to be surrounded by matrix and thus form a blade comprising a matrix layer on a central metal core.

The mold is then closed and placed in a furnace and heated to a temperature at which the alloy 48 fuses and infiltrates downwardly into the mass of particulate material 50. The mold is then cooled so that the binder alloy solidifies, binding the tungsten carbide particles together and to the mandrel 14 so as to form a solid infiltrated matrix surrounding the mandrel 14 and in the desired shape of the outer surface of the bit body.

When the matrix-covered mandrel is removed from the mold, the formers 42, 44 and 46 are removed so as to define the passages in the bit body and the sockets for the cutters, and the upper end of the mandrel 14 is then machined to the appropriate final shape, as indicated by the dotted lines 52 in FIG. 2.

After machining of the mandrel 14 and brazing of the cutters 24 into the sockets in the blades 20, the pre-machined steel shank part 12 is welded to the upper end of the mandrel 14.

In this prior art method of manufacture of a drill bit, the infiltration heating/cooling cycle has the effect of reducing the hardness and strength of the steel mandrel 14. Also, in order to braze the cutters 24 into their respective sockets on the blades 20 the drill bit must also be subjected to a heating/cooling cycle in a furnace, which also tends to reduce the hardness and strength of the mandrel 14. It is for this reason that the shank part 12 of the drill bit is separately formed and subsequently welded to the mandrel in order to avoid the shank part also being reduced in hardness and strength as a result of the heating/cooling cycles.

As previously explained, the necessity of having to weld the shank part to the mandrel not only increases the cost of manufacture, but having to design the components in a manner so that they can be welded together provides a constraint on the design of the bit, and in particular on its minimum axial length. Accordingly, if such welding could be avoided, the bit could be made shorter in axial length which may be desirable for some usages, for example in steerable drilling systems.

Figure 3:
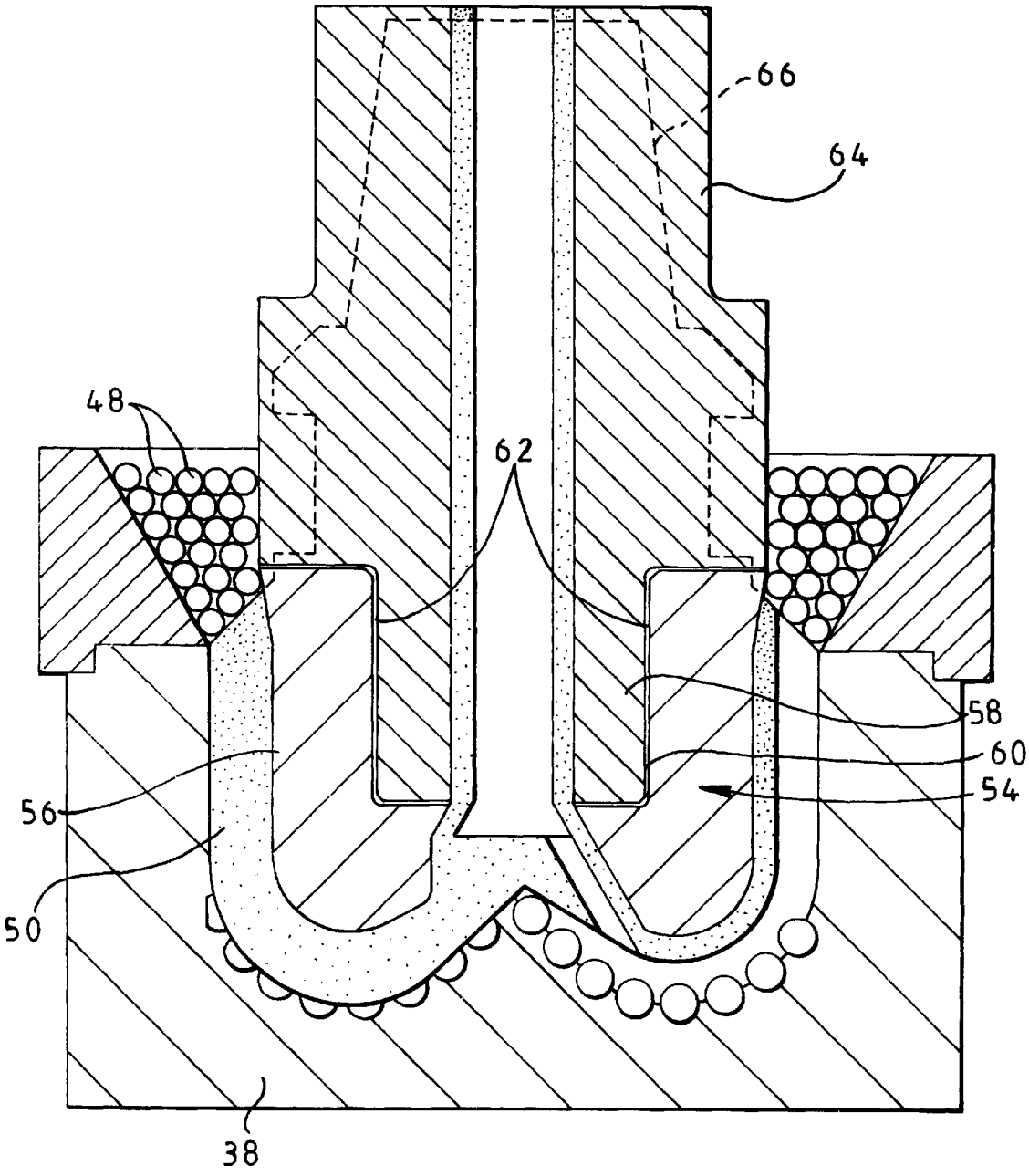
FIG. 3 shows diagrammatically the manufacture of a matrix-bodied drill bit by a method according to the present invention.

FIG. 3 illustrates a modified method of manufacture according to the present invention. Parts of the apparatus corresponding to parts shown in FIG. 2 have the same reference numerals.

As in the prior art arrangement a metal mandrel 54 is supported within a mold 38, matrix-forming material 50 is packed into the spaces between the mandrel 54 and the inner surface of the mold 38 and is infiltrated in a furnace by a molten binding alloy provided by bodies 48 of the alloy located in an annular chamber surrounding the mandrel 54.

According to the present invention, however, the mandrel is formed in two parts comprising an outer part 56 and an inner part 58. The inner part 58 is cylindrical and is received in a corresponding cylindrical socket 60 in the outer part 54. A brazing gap 62 is formed between the inner and outer parts and, during the infiltration process, molten alloy from the bodies 48 infiltrates into the brazing gap 62 so as to braze the inner part 58 to the outer part 56.

In the preferred embodiment of the invention the steel or other alloy from which the inner part 58 of the mandrel is formed is a precipitation hardening alloy. As previously described, when a precipitation hardening alloy is subjected to an appropriately controlled heating/cooling cycle, particles of constituents of the alloy precipitate and locally distort the lattice of the alloy at the microscopic level to create local stress zones and thereby increase the hardness and strength of the material.

One suitable form of alloy for use in manufacture of the inner part of the mandrel is a 17–4 PH grade of martensitic precipitation hardening stainless steel having the following chemical composition:

| | Weight % | |
|---|---|---|
| | Minimum | Maximum |
| Carbon | | 0.07 |
| Silicon | | 1.00 |
| Manganese | | 1.00 |
| Phosphorus | | 0.04 |
| Sulphur | | 0.03 |
| Chromium | 15.00 | 17.50 |
| Molybdenum | | 0.50 |
| Nickel | 3.00 | 5.00 |
| Niobium | 5 × C min | 0.45 |
| Copper | 3.00 | 5.00 |

The metal may be that which conforms to the following standard specifications:

AMS 5622 (remelt)

AMS 5643 QQ-S-763B

MIL-S-862B

MIL-C-24111 (Nuclear)

ASTM A564-72 Type 630

W.1.4548

NACE MR.01.75

During the infiltration process the mandrel 54 is heated to a temperature of about 1160° C. before being cooled to room temperature. During the heating part of this cycle, the majority of any existing precipitates in the alloy are dissolved into solid solution. During the subsequent cooling from the infiltration temperature, precipitates of constituents of the alloy are formed in solution as the first stage of a precipitation hardening process. When the bit body is subjected to a further heating/cooling cycle in order to braze the cutters into the sockets in the matrix part of the bit precipitation hardening is completed.

The inner part 58 of the mandrel therefore becomes hardened as a result of the processes to which the bit is subjected during manufacture and does not have its hardness and strength reduced as is the case with the mandrels in prior art methods. This allows the inner part of the mandrel 58 to be formed integrally in one piece with a body 64 of the same material which may be subsequently machined to provide the breaker slots and threaded pin of the shank, as indicated by the dotted lines 66 in FIG. 3.

The outer part 56 of the mandrel 54 is preferably formed from a non-corrosion-resistant steel which is a non-precipitation hardening steel, and may for example be any of the plain-carbon steels previously mentioned.

The outer part 56 of the mandrel will become reduced in hardness and strength during the heating/cooling cycles to which the bit is subjected, but this will not matter since it is separate from the different body of material 64 from which the shank of the drill bit is formed. However, the outer part 56 of the mandrel may have thermal characteristics which are closer to the thermal characteristics of the solid infiltrated matrix than are the thermal characteristics of the inner part 58 of the mandrel. Any tendency for the solidified matrix to crack during the heating/cooling cycles, as a result of mis-match of thermal characteristics, is therefore reduced or eliminated.

Although it is a major advantage of the present invention that it enables the shank portion of the drill bit to be integral with part of the mandrel, thus avoiding the necessity of subsequently welding the shank to the mandrel, the invention does not exclude arrangements where the shank is subsequently welded to a two-part mandrel in accordance with the present invention, since the inclusion of an inner part to the mandrel which maintains its strength and hardness during manufacture will still enhance the strength of the finished drill bit in any case, and this in itself is advantageous.

Figure 4:
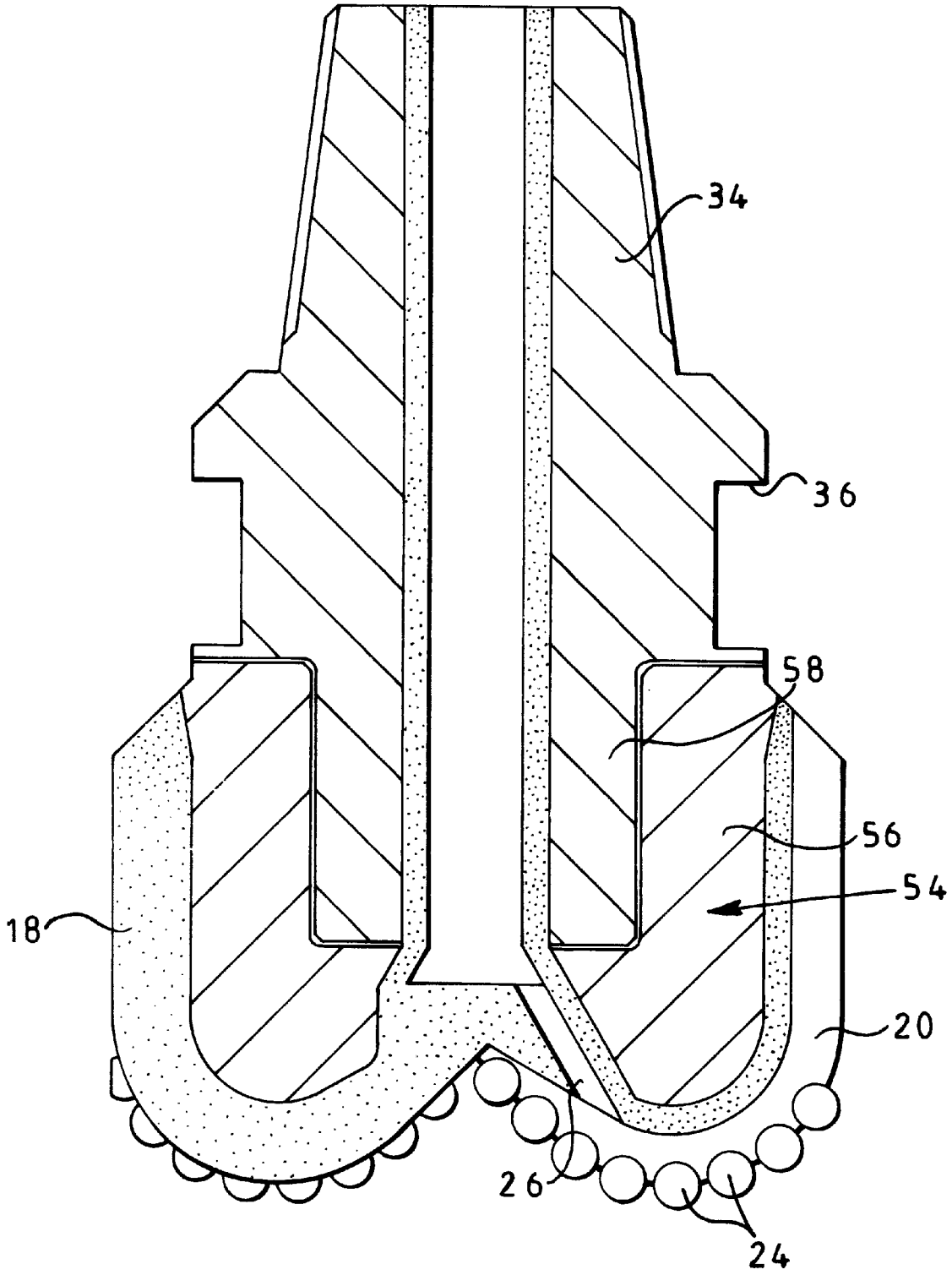
FIG. 4 is a diagrammatic section through a rotary drag-type drill bit according to the invention.

FIG. 4 shows a finished drill bit manufactured by the method according to the present invention. Comparing this with FIG. 1, it will be seen that, since there is no necessity of welding the shank to the mandrel, the breaker slots 36 on the shank are much closer to the leading face of the bit than they are in the prior art arrangement, and the overall axial length of the bit is therefore reduced.

Other suitable forms of precipitation hardening alloys which may be used in the invention are 15–5 PH grade and 520B grade stainless steels having the following typical compositions.

15–5 PH Grade:

| | Weight % | |
|---|---|---|
| | Minimum | Maximum |
| Carbon | | 0.07 |
| Silicon | | 1.00 |
| Manganese | | 1.00 |
| Phosphorus | | 0.03 |
| Sulphur | | 0.015 |
| Chromium | 14.00 | 15.50 |
| Molybdenum | | 0.50 |
| Nickel | 3.50 | 5.50 |
| Niobium | 5 × C min | 0.45 |
| Copper | 2.50 | 4.50 |

The metal may be that which conforms to the following standard specifications:

AMS 5659 (remelt)

ASTM A630 Type XM12

520B Grade:

| | Weight % |
|---|---|
| Carbon | 0.05 |
| Chromium | 14.00 |
| Molybdenum | 1.70 |
| Nickel | 5.60 |
| Niobium | 0.30 |
| Copper | 1.80 |

The metal may be that which conforms to the following standard specifications:

BS.5143

BS.5144

Other proprietary grades of stainless steel may be used allowing up to 3% Molybdenum, 0.15% carbon 8% nickel and down to 13% chromium.

Semi-austenitic precipitation hardening stainless steels may also be employed, including 17–7 PH grade stainless steel having the following composition:

| | Weight % |
|---|---|
| Carbon | 0.07 |
| Chromium | 17.0 |
| Nickel | 7.0 |
| Aluminum | 0.4 |
| Titanium | 0.4 to 1.2 |

Other proprietary grades of semi-austenitic precipitation hardening stainless steels may be used, in grades allowing up to 0.2% carbon, 2% copper, 3% molybdenum, 2% cobalt, 1.2% aluminum, 2% cobalt, 0.3% phosphorus and down to 12% chromium and 3.5% nickel. All percentages are by weight.

Although the specific alloys described in this specification are steel, and this is preferred, the present invention does not exclude the use of other precipitation hardening alloys in the manufacture of the inner part of the mandrel.

Whereas the present invention has been described in particular relation to the drawings attached hereto, it should be understood that other and further modifications, apart from those shown or suggested herein, may be made within the scope and spirit of the present invention.

What is claimed:

1. A method of manufacturing a rotary drill bit comprising a bit body having a threaded shank for connection to a drill string and a leading face on which cutters are mounted, the method including the step of locating a metal mandrel within a mold, packing the mold around at least part of the mandrel with particulate matrix-forming material, infiltrating said material at elevated temperature with a molten binding alloy, and cooling the material, binding alloy and mandrel to form a solid infiltrated matrix bonded to the mandrel, the mandrel being formed in at least two parts including an outer part surrounded by a main body of said matrix-forming material and an inner part which engages with the outer part of the mandrel and is out of contact with said main body of matrix-forming material wherein said inner part is brazed to said outer part by the molten binding alloy.

2. A method according to claim 1, wherein the inner part of the mandrel is formed from a precipitation hardening alloy, the method including the step of submitting the mandrel to a heating and cooling cycle in a manner to effect precipitation hardening of the alloy from which the inner part is formed.

3. A method according to claim 2, wherein the heating and cooling cycle is that applied in the infiltration process.

4. A method according to claim 2, wherein the heating and cooling cycle is that applied in a process for subsequently brazing cutters to the bit body.

5. A method according to claim 2, wherein the heating and cooling cycle is that applied both in the infiltration process and in a process for subsequently brazing cutters to the bit body.

6. A method according to claim 2, wherein the precipitation hardening alloy is a precipitation hardening alloy steel.

7. A method according to claim 6, wherein the precipitation hardening alloy is selected from a martensitic and semi-austenitic type steel.

8. A method according to claim 6, wherein the precipitation hardening alloy is a stainless steel.

9. A method according to claim 2, wherein the precipitation hardening alloy is a nickel based alloy.

10. A method according to claim 2, including the step of heating the precipitation hardening alloy quickly to a precipitation hardening temperature and holding at that temperature for a prescribed time; followed by a fast cool back to room temperature.

11. A method according to claim 2, including the steps of first taking all the precipitates in the alloy into solution at a high "solution treatment" temperature; followed by fast cooling to room temperature; followed by heating quickly to a lower precipitation hardening temperature and holding at that temperature for a prescribed time; followed by a fast cool back to room temperature.

12. A method according to claim 3, wherein the heating/cooling cycle to which the bit body is subjected during the infiltration process is controlled so as to effect a preliminary "solution" heat treatment prior to precipitation hardening effected by controlling the heating/cooling cycle to which the bit body is subjected during brazing the cutters to the bit body.

13. A method according to claim 1, wherein the outer part of the mandrel is formed from a non-corrosion-resistant steel.

14. A method according to claim 13, wherein the outer part of the mandrel is formed from a plain-carbon steel having a carbon content in the range of 0.36% to 0.44%.

15. A method according to claim 1, wherein the inner part of the mandrel is engaged with the outer part of the mandrel by a method selected from: a threaded connection, an interference fit, an adhesive, welding.

16. A method according to claim 1, wherein there is provided between the inner and outer parts of the mandrel a brazing gap which is filled with molten brazing alloy during the infiltration of the matrix-forming material at elevated temperature, so as to braze the inner part to the outer part.

17. A method according to claim 16, wherein the brazing alloy comprises part of the binding alloy which infiltrates the matrix-forming material.

18. A method according to claim 1, wherein the matrix-forming material packed around the mandrel includes a portion, in addition to said main body of matrix-forming material, which engages a surface of the inner part of the mandrel.

19. A method according to claim 18, wherein the inner part of the mandrel includes an internal passage which is lined with matrix-forming material.

20. A method according to claim 1, wherein the inner part of the mandrel is coaxial with the outer part of the mandrel and has a cylindrical portion which engages within a registering cylindrical socket in the outer part.

21. A method according to claim 1, including the further step of machining an integral portion of the inner part of the mandrel to form the threaded shank of the drill bit.

22. A method according to claim 1, including the further step of securing a separately formed member to the inner part of the mandrel, after formation of the solid infiltrated matrix, to form the threaded shank of the drill bit.

23. A rotary drill bit comprising a bit body having a threaded shank for connection to a drill string and a leading face on which cutters are mounted, the bit body comprising a metal mandrel, around part of the outer surface of which is formed a main body of solid infiltrated matrix material comprising a particulate matrix-forming material and a binding alloy, said mandrel comprising an outer part surrounded by said main body of solid infiltrated matrix material, and an inner part which engages the outer part, said inner part being formed of an alloy which has been precipitation hardened material wherein said inner part is brazed to said outer part by the binding alloy.

24. A rotary drill bit according to claim 23, wherein said inner part of the mandrel is out of contact with said main body of solid infiltrated matrix material.

25. A rotary drill bit according to claim 23, wherein said threaded shank of the drill bit is integral with said inner part of the mandrel.

* * * * *